United States Patent [19]

de Kat

[11] 4,409,916

[45] Oct. 18, 1983

[54] SPLIT VESSEL OR SIMILAR VESSEL

[75] Inventor: Ewout C. de Kat, Ridderkerk, Netherlands

[73] Assignee: IHC Holland N.V., Papendrecht, Netherlands

[21] Appl. No.: 249,362

[22] Filed: Mar. 31, 1981

[30] Foreign Application Priority Data

Mar. 31, 1980 [NL] Netherlands ..... 8001892

[51] Int. Cl.[3] ..... B63B 35/30

[52] U.S. Cl. ..... 114/29; 91/360

[58] Field of Search ..... 114/27-30; 91/411 B, 360

[56] References Cited

U.S. PATENT DOCUMENTS

| | | | |
|---|---|---|---|
| 2,738,770 | 3/1956 | Granzow | 91/411 B |
| 3,401,661 | 9/1968 | Van Der Werff | 114/29 |
| 3,404,650 | 10/1968 | Miller | 114/29 |
| 3,631,827 | 1/1972 | Van Der Werff | 114/29 |
| 4,094,228 | 6/1978 | Schexnayder | 91/411 B |
| 4,261,275 | 4/1981 | Demmers | 114/29 |

FOREIGN PATENT DOCUMENTS

| | | | |
|---|---|---|---|
| 6909898 | 1/1970 | Netherlands | 114/29 |
| 7605773 | 5/1976 | Netherlands | 114/29 |

*Primary Examiner*—Sherman D. Basinger
*Assistant Examiner*—Stephen P. Avila
*Attorney, Agent, or Firm*—Young & Thompson

[57] ABSTRACT

The invention relates to a split hopper vessel consisting of two halves, which can swing about a horizontal longitudinal axis between a closed position in which the hold formed by the two halves is closed and an open position in which the two halves are moved apart. The two halves are interconnected by hydraulic cylinders which can perform or assist the opening and/or closing of the vessel. The hydraulic cylinders under the control of non-return valves (10,11,53) which block the closed position and which by a control pressure system can open to allow the opening of the vessel. The flow of liquid from one side of each cylinder to the other side can be shortened, and safety structure ensures that all cylinders operate simultaneously, all non-return valves (10,11) having a pressure-activated switch, which when activated opens the non-return valve $G_1$ in the line connecting both sides of each cylinder. The hydraulic circuit can consists of a high pressure section and a low pressure section which can be put into operation in dependence on what the closing or opening operation requires.

7 Claims, 6 Drawing Figures

1
2
3
4
5
6
7
8
9
10
11
12
13
14
15
16
17
18
20
21
22
23
24
25
25a
26
27
28
29
30
31
32
61
G2
H1
H2
S1
S2
S3
S4
E1
E2
E3
B

| | S1 | S2 | S3 | S4 | D1 | D2 |
|---|---|---|---|---|---|---|
| 1 | | | | | | X |
| 2 | | X | X | X | X | |
| 3 | X | X | X | X | X | |
| 4 | X | X | X | | X | |

Fig-5

| | FUNCTION | PUMPS | | | | SOLENOID VALVES | | | | | REMARKS |
|---|---|---|---|---|---|---|---|---|---|---|---|
| | | 40 | 40 | 41 | 41 | 55 | 56 | 57 | 58 | 59 | |
| 1 | CLOSING PUMPS CLOSE VESSEL | | | X | X | | X | X | | X | |
| 1 | CLOSING VESSEL SELF CLOSING | | | X | X | | X | X | | X | |
| 1a | CLOSING, HIGH PRESSURE (SEALING) | X | X | | | X | | X | | | BY PRESSURE SENSOR P1 |
| 1b | REPRESSURIZING CYLINDERS | X | X | | | X | | | | | PUMPS 41 STOP BY PRESSURE SENSOR P1 |
| 2a | SCATTERING LOAD | | | X | X | | | | X | | 58 SWITCHES OFF AFTER 3 SECONDS |
| 2b | RIMSING HOPPER | | | X | X | | | | | | |
| 3 | OPENING VESSEL SELF OPENING | | | X | X | | X | | X | | |
| 3 | OPENING PUMPS DO THE OPENING | | | X | X | | X | | X | | |

Fig-6
PRIOR ART

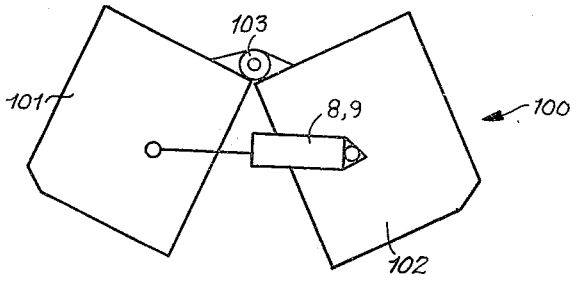

SPLIT VESSEL OR SIMILAR VESSEL

The invention relates to a split hopper vessel or similar vessel consisting of two halves fitting together along the longitudinal central cross sectional plane and being connected to each other by means of hinges having a horizontal axis, said two halves furthermore being coupled to one another by means of hydraulic cylinders provided in the neighbourhood of said hinges, which hydraulic cylinders are capable of at least performing the closing movement and have been included in a hydraulic circuit to which close to said cylinders flexible tubes have been provided for transferring hydraulic liquid to and from said cylinders.

Such a vessel is known in general. Vessels of this type are usually constructed in such manner, particularly in case of hopper barges which have not been provided with propelling and steering means of its own, that such barges in the filled condition will be capable of opening on their own accord upon release of the connection between the two halves of the vessel and of automatic reclosure in the emptied condition. Upon opening the two halves will hingedly move apart whereby the charge may drop downward; upon reclosure the two halves hingedly move towards each other.

In order to assure that the vessels will also be closed properly and to sealingly keep the two halve of the vessel together in the closed and charged condition, the known vessels or barges are provided with hydraulic cylinders at the location of the hinges by means of which cylinders the two halves are kept together.

In view of the large forces required to keep the two halves of the vessel tightly together these cylinders are of large dimension which dimensions have become very large due to the increasing size of such vessels. Where upon opening and closure large amounts of hydraulic liquid have to be transferred there will be required a considerable number of high pressure tubes for each one of the cylinders, because reliable high pressure tubes of high flow capacity are not yet available. Consequently the risk of tube failure is high and if such tube failure occurs the closing pressure will disappear and hence opening of the vessel may occur at any undesired moment.

Due to the increasing dimensions of split hopper vessels it becomes increasingly harder to build such vessels with self-opening and self-closing characteristics.

Moreover it is conceivable that the vessels will be loaded with charges of very high coherence, such as a stiff clay whih charges will yield an insufficient pressure for opening the vessel if such vessel is not constructed as a self-opening vessel.

The object of the invention is now to provide a ship or vessel, which is safeguarded against untimely opening thereof. A further object of the invention is to provide a ship or vessel the opening and closure of which may be controlled and may be performed forcedly if required in order to assure that the moements of the masses are controlled and the movements to be performed are consequently performed completely.

Firstly these objects are achieved in that in the pressure supply lines there is provided a non return valve between each cylinder and each flexible tubes, said non return valve passing liquid in the direction of closure and blocking in the reverse direction, said non return valve furthermore being provided with a control means for opening said valve under the influence of a control pressure.

These non return valves allow closure while under pressure so that the closure movement may be supported or completed, respectively, if required, and preclude from any opening except in case the non return valves are opened uner the influence of control pressure. Solely in the latter case the liquid may flow back so that the liquid may be discharged from the cylinders and the halves of the vessel may move apart.

For performing such opening it might suffice to allow the liquid discharged from the cylinders to flow back to the tank and to supply liquid to the other side of the piston of the cylinders. In such instance however lines of considerable length are concerned, particularly to the cylinder or cylinders provided at the front part of the vessel and consequently present at considerable distance from the engine room usually located in the hind part in which the hydraulic operating installation is installed.

Therefore it is preferred that between the rod side and the head side of each cylinder there is provided a non return valve which blocks the passage from the rod side to the head side and which may be opened under the influence of a control pressure. This controllable non return valve which is located preferably close to the cylinder or cylinders present at the fore body, will assure, if opened under the influence of its control pressure, that the liquid leaving the rod side will flow to the head side of the cylinder so that less liquid has to be supplied at once than in case the head side should be fed completely from the tank.

It may be advantageous to render this control pressure dependent on the presence of control pressure on all non return valves provided at all cylinders between flexible tubes and cylinders. It is of great importance for that matter that both the hinges will move in a similar way i.e. at the same angular velocity and will start and stop, respectively, at the same time. The presence of control pressure on all non return valves may be determined in that at each one of the non return valves present between flexible tubes and cylinders there is provided a switch capable of being activated by the control pressure, for an electromagnetic valve in the control pressure line to the non return valve between the rod side and the head side in which position said valve passes the control pressure to said back pressure valve.

It is conceivable to unite the non return valves between cylinders and flexible tubes in the pressure supply line and the non return valve between rod side and head side of the cylinders to a single valve mounted somewhere in or at the cylinder wall or preferably accommodated in the piston.

By means of this controllable non return valve between rod side and head side of the cylinders the opening may be controlled and may be stopped, if necessary. If for some reason or other the pump pressure would disappear or the voltage in the electric circuit would fail the control pressures will disappear and the non return valves will block the opening movement or further opening movement, respectively. The vessel may then close indeed for liquid may flow from the head side to the rod side provided the liquid in excess with respect to the rod side may flow back to the tank from the head side.

According to the invention it is therefore preferred that in the hydraulic circuit between the head side of the cylinder and the tank there is provided a controllable non return valve preventing the back flow to said tank. This non return valve thus prevents the back flow but allows a flow from the tank to the head side of the cylinders when opening.

Now, in order to assure the return flow when closing the control pressure is derived from the pressure in the line between the head side of the cylinders and a throttling site present upstream of the non return valve while in the control pressure line there is provided an electromagnetic valve making the circuit in its non-energized condition. At the head side there will always be some pressure certainly when closing and this pressure will now control the non return valve in the connection to the tank.

This control pressure may of course also be derived from the hydraulic pressure circuit by means of an electromagnetic valve.

In an embodiment which is particularly suited for smaller vessels of the self-opening and self-closing type the hydraulic circuit may consist of a high pressure section and a low pressure section, which high pressure section by means of an electromagnetic valve may supply hydraulic liquid to the cylinders by way of the non return valve and by means of an other electromagnetic valve may supply hydraulic liquid to the control line of the non return valves as well as by means of an electromagnetic valve to the control line of the non return valve between the rod side and the head side of the cylinder, the last said valve being present close to that cylinder which is most remote form the pressure source in the tank, while the low pressure section connects the head side of the cylinders to the tank by way of conduits provided with non return valves admitting a flow from said tank to the head side of which non return valves at least one is controllable and the control line of which may be connected to the low pressure section by means of an electromagnetic valve. Such a hydraulic circuit is rather simple.

For larger and heavier vessels it is however preferred that the hydraulic circuit consists of a high pressure section including high pressure pumps of low capacity and a medium pressure section including medium pressure pumps of high capacity as well as a low pressure section, an electromagnetic valve for connecting the rod side at wish to the high pressure section or the medium pressure section, respectively, electromagnetic valves for bye-passing the high pressure pumps or medium pressure pumps, respectively, while all controllable non return valves are present in the medium pressure section of the circuit, said non return valves receiving the control pressure from this medium pressure section of the circuit and the high pressure section is connected to the rod side of the cylinders by way of a non-controllable non return valve, said valve being present between each flexible tube and the cylinder, an electromagnetic valve in the control pressure line to the non return valve in the return line from the head side of the cylinders to the tank, said control pressure line being connected to both the high pressure and medium pressure by way of non return valves and a electromagnetic valve in the connection between medium pressure to the head side of the cylinders.

By means of this circuit a completely controlled opening or closing, respectively, is made possible wherein the forces exerted by the charge present or not may cooperate and are controlled at any rate and are supported if necessary. In this more sophisticated circuit the voltage fails a connection may be made between the rod side and the head side of the cylinders by means of a manually operated connection.

The invention will now be described in further detail with reference to the drawing.

FIG. 5 represents the functional diagram belonging thereto.

FIG. 6 shows schematically a conventional split hopper vessel of the type with which the present invention is used.

Figure 1:
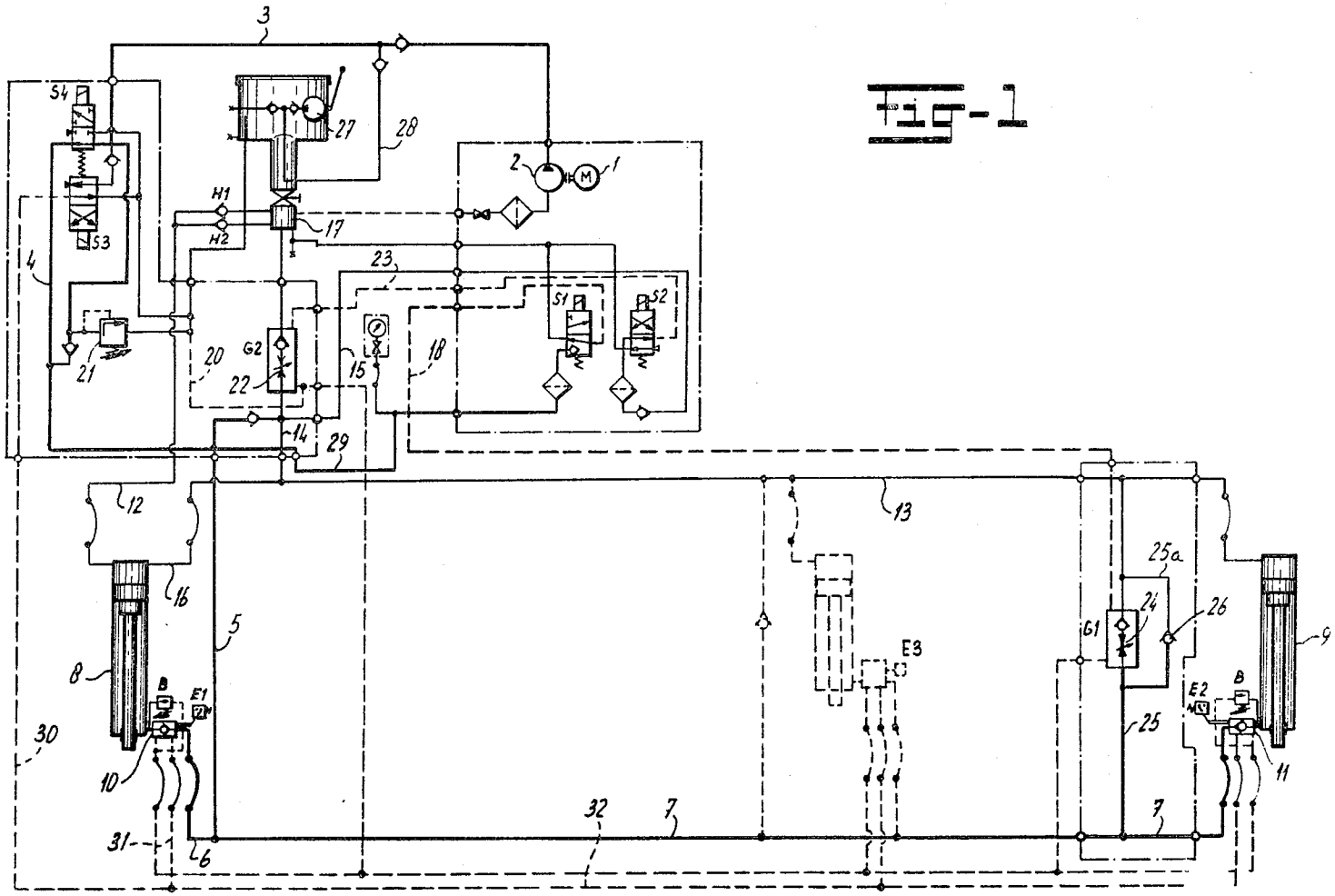
FIG. 1 shows a hydraulic diagram in an embodiment destined for relatively small vessels.
Figures 2, 3:
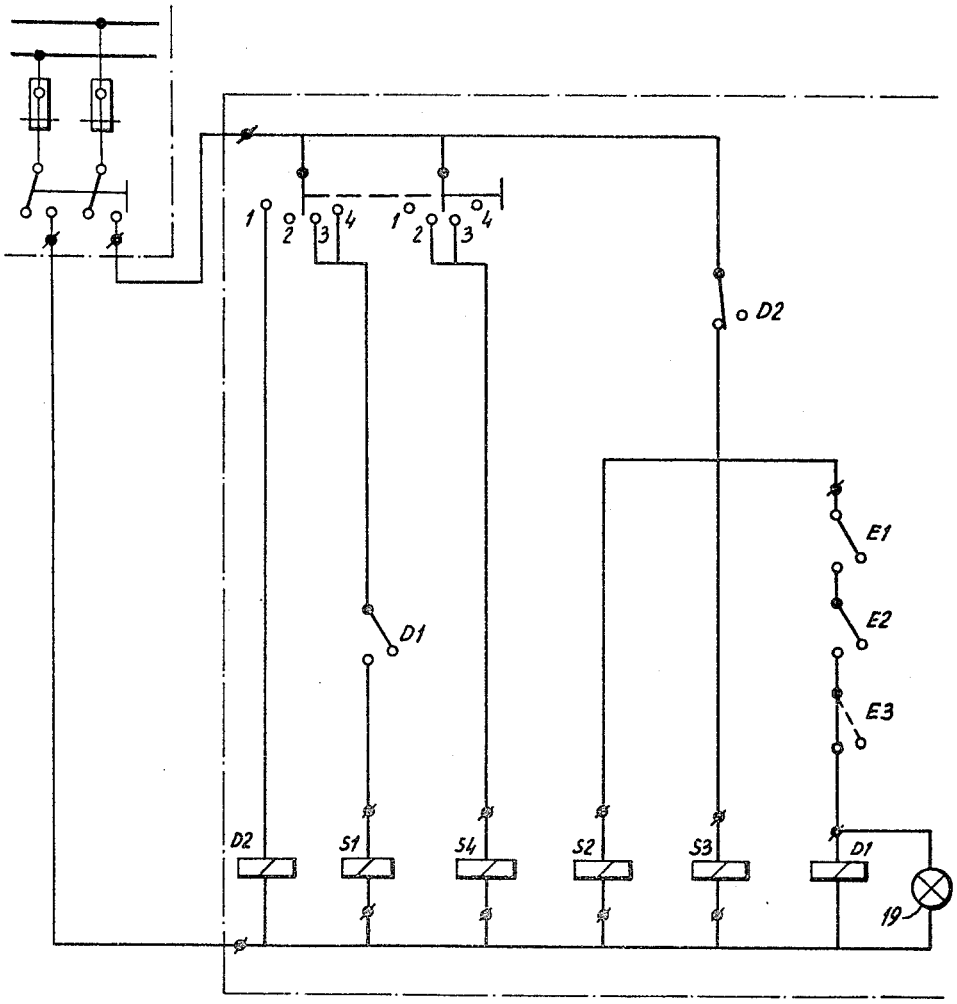
FIG. 2 shows the simplified electric diagram belonging thereto.
FIG. 3 represents a functional diagram belonging thereto.

In the embodiment shown in FIGS. 1, 2 and 3 the electromagnetic valves are indicated by S1, S2, S3 and S4. All said valves have been represented in the non-energized position or position determined by the spring load. The relay controlled switches have been indicated by D1 and S2 and are also represented in the non-energized position. Hence D1 is normally opened and D2 is normally closed. E1 and E2 are pressure switches which are kept in the opened position by means of a spring and which may be closed by pressure in the hydraulic circuit.

Furthermore in the functional diagram of FIG. 3 and in the electric circuit there have been indicated four switching conditions.

It is conceivable that more than two hydraulic cylinders have to be employed in view of the ship building construction of the vessel. In FIG. 1 it has been indicated in dotted lines in which way each following cylinder is inserted into the system. It is even conceivable in that case that the dimensions of the cylinders will differ from each other.

In FIG. 2 it has been indicated that for each additional cylinder an additional pressure switch E3 will be required.

The hydraulic circuit shows a hydraulic pressure cylinder 8 close to the hind part of the vessel and a hydraulic cylinder 9 close to the front part of the vessel.

Furthermore the hydraulic circuit of FIG. 1 shows a motor 1 driving a high pressure pump 2 which may supply hydraulic liquid by way of the high pressure line 3, and valve S4, line 4 and line 5 as well as lines 6 and 7, respectively, and the back pressure valves 10 and 11, respectively, to the rod side of the cylinders 8 and 9. This pressure keeps the pistons in the inserted represented position and hence keeps the vessel closed, said closed position being locked by the back pressure valves 10 and 11, respectively. The back pressure valves are bridged by a pressure regulating valve B adjusted at a predetermined value that may be for instance 290 bar. This value is higher than the normal safety pressure in the circuit determined by the pressure regulating valve 21 between the high pressure line and a leakage or zero circuit 20. The head side of the cylinders is in communication with on the one hand by way of line 12 including non return valves H1, H2 with the tank 17 and on the other hand by way of lines 13 and 16 joining into line 14 and the non return valve G2 with the tank 17. G2 is a controllable non return valve only allowing a flow into the direction of the tank if the valve has been opened under the influence of a control pressure. The valve G2 possesses an adjustable throttling opening 22. The control pressure supplied by way of line 15, electromagnetic valve S2 and the line 23 is derived from the low pressure circuit which is in communication with the head side of the cylinders. During closure in this low pressure circuit a pressure will prevail determined by the resistances in the lines and caused by the throttling site 22 which pressure will yield an sufficient pressure differential to keep G2 opened as long as the hydraulic liquid is in motion.

Close to the front cylinder 9 there is mounted a controllable non return valve G1 which has also been provided with a throttling site 24 and which is located in a connection line 25 between the high pressure line 7 and the low pressure line 13. In aiding the flow of liquid during the closure movement of the vessel this non return valve G1 has been bridged by a line 25*a* including a non return valve 26 the latter not being controllable.

The operation of the device shown and for that matter only diagrammatically being represented in FIGS. 1, 2 and 3 is as follows.

In the switching position 1 shown in FIG. 3 the closure of the vessel is concerned. This position D2 is energized which means that switch D2 is broken. The electromagnetic valves S2 and S3 will then be in the position determined by the spring load like shown. The same holds for S1 and S4.

If now pressure is exerted by pump 2 (the electrical circuit of the motor 1 has not been shown) hydraulic liquid will flow in a way described above from the high pressure line 3 through line 4 to the rod side of the cylinders 8 and 9.

At the head side hydraulic liquid may be discharged through non return valve G2 because in the line portion upstream of G2 the pressure at the head side of the piston will prevail which pressure by way of lines 15 and the valve S2 as well as the line 23 is exerted on the control gate of the non return valve G2.

In this way closure becomes possible. When in the closed position now further movement is possible anymore the pressure may not rise beyond for example 260 bar this being the value adjusted by the pressure regulating valve 21.

If the voltage fails pressure may be imparted to the system by means of the manually operated pump 27 and line 28.

In the switching position 3 the opening may occur. In this position D1 is energized and consequently S1 is in its activated position. Likewise valve S4 will be brought in its activated position thus blocking the supply of hydraulic liquid to the rod side of the cylinders.

Where the switch D2 is in making position the electromagnetic valves S2 and S3 are likewise brought in their activated position. For S3 this means that high pressure now reaches by way of S3 the control line 30 including branches 31 and 32 to the non return valves 10 and 11, respectively.

The above mentioned flexible tubes have been represented by curved line sections in this diagram. The control pressure on the non return valves 10 and 11 puts them in the opened position while likewise assuring the closure of the switches E1 and E2. Consequently the electrical circuit of the switch D1 is closed and the valve S1 is put in operated position. The hydraulic fluid on the rod side of the cylinders 8 and 9 may then flow away through valves 10 and 11, respectively.

By energizing the valve S1 the hydraulic liquid flowing back through connections 5, 29, S1 and 18 may yield a control pressure to the non return valve G1 due to which at the front cylinder a connection is created between the rod side and the head side of the cylinder; a connection for that matter also holding for the back cylinder 8 through the connections 6, 7 and 13 and 16, respectively.

At the head side of the hind cylinder the hydraulic liquid may directly be supplied by way of non return valves H1, H2 and the line 12. At the head side of the cylinder 9 the hydraulic liquid is supplied from the rod side by way of 25 and G1 amplified by hydraulic liquid through 16 and 13 as well as from the tank 17 by way of the non return valve G2 and line 14.

Consequently the hydraulic liquid from the rod side of both cylinders will flow essentially to the head side of the front cylinder 9 while yielding in the meantime the control pressure for the non return valve G1. At the head side of the cylinder 9 there will consequently be no need to supply much additional hydraulic liquid via the long line 13, whereas such supply at the head side of the cylinder 8 does not cause much problems because the connection to the tank is short at that place.

The two switches E1 and E2 have created a safeguard for the simultaneous operation of both cylinders, so that the vessel could not open in an oblique manner which situation would be signalized by means of the lamp 19. In case only one of the switches E1 and E2 would have been closed the valve S1 would not have received any voltage and the control pressure derived from the rod side of the cylinders could not influence the non return valve G1 which then will block the connection between the rod side and the head side.

It is conceivable, that the opening movement does not occur on its own accord or not in a sufficient manner.

In switching position 4 the opening may then be performed by means of pump pressure. In this position the same electromagnetic valves are energized and switch D1 is in the same position like in position 3 with the exception of the electromagnetic valve S4. The valve S4 will then be in the position determined by the spring load like shown in the drawing, so that high pressure is supplied to the rod side. The said pressure is however also supplied to the control gates of the non return valves 10 and 11 and by way of valve S1 to the control gate of the non return valve G1, connecting the head side and the rod side of the cylinders to one another. This means that on both sides of the pistons in the cylinders the same pressure will prevail so that they due to the force differential on both sides of the piston which force at the head side is larger than at the rod side will be forced to move in the direction causing opening of the vessel.

In switching position 2 the valve S1 is in the position determined by the spring load and consequently there will be no control pressure on the non return valve G1. Such pressure is moreover absent because the valve S4 has been energized and pressure supply is prevented to the rod side of the cylinders and to valve S1 and non return valve G1, respectively.

However the valves S2, S3 and S4 are energized indeed and occupy their activated position. Consequently the valve S2 blocks the control pressure to valve G2, the latter blocking all back flow of hydraulic liquid from the head side of the cylinders to the tank. S3 provides for control pressure on the non return valves 10 and 11. Relay D1 is energized because switches E1 and E2 are closed but there is no voltage on the switching part of D1, so that S1 remains in the position determined by the spring load. Although the hydraulic liquid discharged from the rod side of the cylinders might pass the non return valves 10 and 11 such flow would yet be blocked by the non return valve G1. Consequently the piston remains blocked in the cylinder, a situation which may occur in any intermediate position during the opening or closure movement of the vessel by placing the switch in the position 2.

Such a partially opened position may be utilized for the controlled discharge or scattering the material present in the hold or the case of empty or practically emptied holds for rinsing the vessel.

The described diagram is only schematical.

Figure 4:
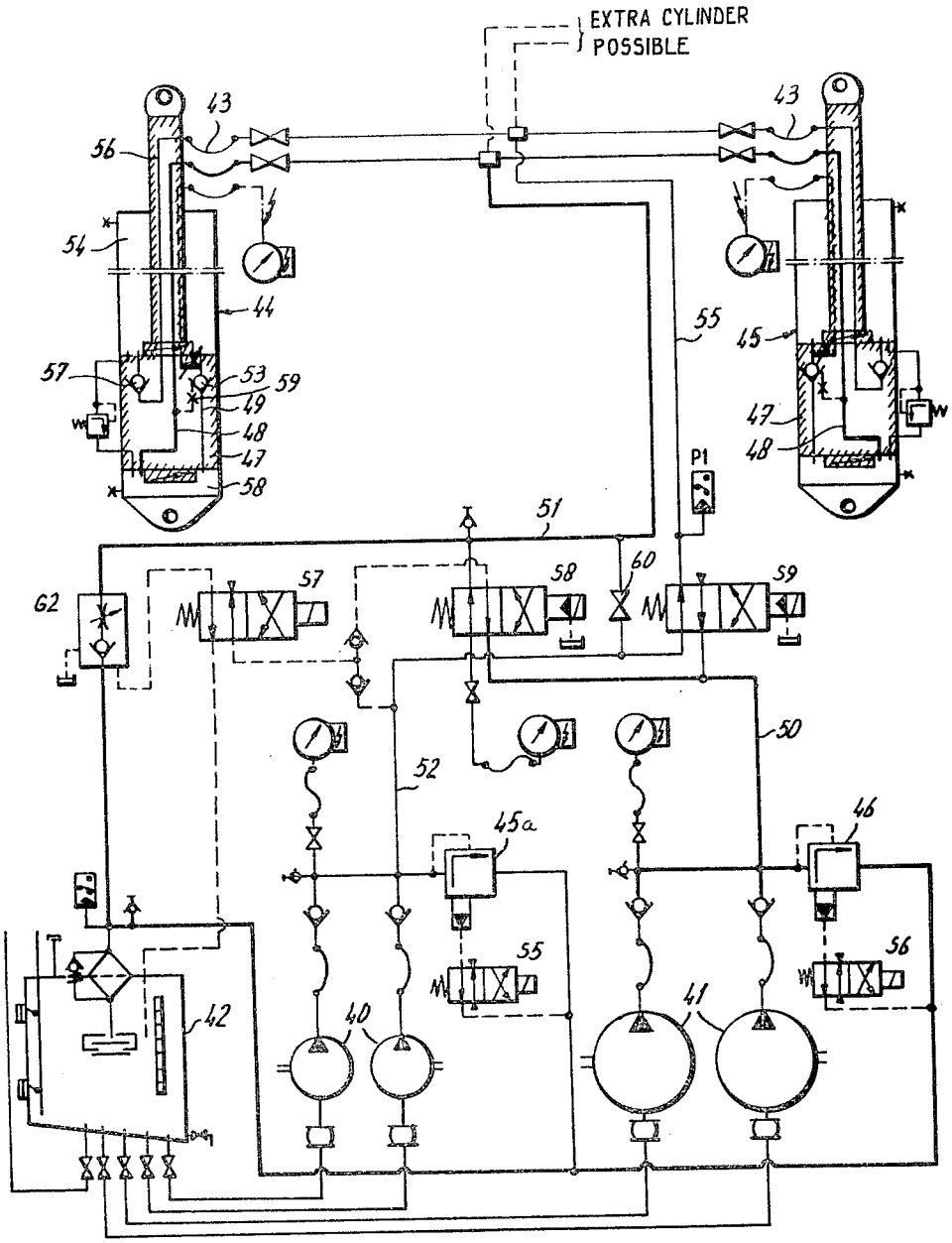
FIG. 4 shows the hydraulic diagram of a hydraulic circuit of a larger vessel.

FIG. 4 shows an embodiment destined for larger vessels while FIG. 5 shows the accessory functional diagram.

In this embodiment the hydraulic system includes high pressure pumps 40, medium pressure pumps 41, a tank 42 and pressure cylinders 44, 45 for the hind body and the front part of the vessel. The flexible tubes have been indicated by the reference numeral 43.

It is conceivable that the ship building construction of the vessel will require the use of more than two hydraulic cylinders. In FIG. 4 dotted lines indicate the way in which each next cylinder should be inserted into the system. In that case it is even conceivable that the dimensions of the cylinders with respect to each other will differ.

The high pressure pumps 40 may be short-circuited by means of a valve S5 as indicated in the drawing by the position determined by the spring load. Furthermore a safety valve 45*a* has been provided limiting the pressure to for example 250 bar. These pumps 40 which may yield high pressure have however a low capacity.

The pumps 41 may be bye-passed by means of the valve S6 in the represented position determined by the spring load and the pressure in the circuit fed by said pumps is determined by the safety valve 46 which is adjusted at for instance 170 bar. These pumps yield a medium pressure which consequently is appreciably lower than the pressure that may be supplied by the pumps 40, but said pumps 41 may provide a higher capacity which is required to attain a higher velocity in large cylinders. Apart from the electromagnetic valves S5 and S6 there are furthermore provided valves S7, S8 and S9. Valve S7 controls the control pressure derived from the high pressure circuit or the medium pressure circuit to the control gate of the non return valve G2 in the return line from the head side of the cylinders to a tank 42.

The pistons have been indicated by the reference numeral 47. Valve S8 provides in resistance a connection between the medium pressure in line 50 with the line 51 which by means of a flexible tubes 43 and a channel through the piston rod and the piston indicated by 48 supplies hydraulic liquid to the head side of the cylinders 47 and by means of the connection 49 with the non return valve 53 to the rod side 54 of the cylinder 44.

The valve S9 determines whether the line 55 by way of chahnnel 56 in the piston rod and the non return valve 57 and consequently the space 54 at the rod side will be brought under the pressure of the pumps 40 or of the pumps 41, that is to say high pressure or medium pressure.

The operation of the device shown in the drawings is as follows.

From the functional diagram it is evident, that for a closure of the vessel, it being irrelevant whether the vessel is self-closing or the ship has to be closed by means of pumps, the same switching operations have to be performed.

These functions have been indicated in the functional diagram by 1.

At 1*a* the closure under high pressure is indicated for obtaining a good sealing, while at 1*a* the prepressurizing of the cylinders has been indicated.

At 2*a* the partial opening of the vessel for scattering the charge and at 2*b* the partial opening for rinsing the hopper has been indicated.

At 3 the opening of the vessel has been indicated and from the functional diagram it may be derived that both upon opening by the vessel as such as well as by the opening by means of pumps the same means are in operation.

Furthremore it may derived from the functional diagram that upon closure as well as upon opening and at partial opening i.e. in case of functions 1, 3, 2*a* and 2*b* the medium pressure pumps 41 are in operation and the high pressure pumps 40 are only in operation upon closure under high pressure and upon prepressurizing the cylinders.

Upon closure, indicated in the functional diagram by 1 the magnetic valves S6, S7 and S9 are energized. S6 assure that the medium pressure pump 41 will not be bye-passed and will consequently be able to supply pressure to the circuit. The pumps 41 consequently deliver hydraulic liquid to the line 50 and to the line 55, because S9 is energized and consequently via flexible tubes to the line 56 through the non return valve 57 to the rod side 54 of the cylinder 44. Moreover S7 is energized so that the pressure prevailing in the line 50 may yield control pressure by way of S8 in the position controlled by the spring load and S7 in the energized position to the non return valve G2 so that this valve is opened, whereby hydraulic liquid at the head side may flow from the pistons to the tank by way of lines 48, 51.

When the forces acting on the vessel are capable of causing a self-closure of the vessel, such closure will also occur if the said magnetic valves S6, S7 and S9 in the same position.

A vessel having the property of self-closure may be apt to a slow or quick closure. If said closure occurs too slowly an automatic closure will take place by means of the hydraulic liquid supplied by the pumps 41.

Whenever the closure occurs too quickly, the pressure in the control line to the non return valve G2 will drop so that said valve will close and retard the back flow of hydraulic liquid from the head side of the cylinders to the tank 42. The closure rate is consequently automatically controlled.

If according to 1*a* closure occurs under high pressure, for instance in order to assure a good closure of the hopper the magnetic valve S6 will be in the position determined by the spring load in accordance with the functional diagram so that the pumps 41 are bye-passed and the magnetic valves S5 will be in the energized position so that the pumps 40 may discharge their hydraulic liquid under high pressure. Where S9 is also in the position determined by the spring load the high pressure hydraulic liquid from pumps 40 will reach through line 52 line 55 and from said last line the cylinders in a similar way as described for the closure. The high pressure in line 52 provides for the energized magnetic valve S7 for the control pressure on the non returne valve G2.

The line 55 has been provided with a pressure switch P1 in the electrical circuit of the magnetic valves S5 and/or S6 so that upon reaching a predetermined pressure corresponding to the closure pressure the energization of the magnetic valves is released and the pumps in operation are bye-passed.

The same occurs also when prepressurizing the cylinders like indicated in 1*b*. Such prepressurizing may occur when the closed vessel the closed condition of which has been secured by locks has to be prepared for the several steps to be performed by means of the device according to the invention or whenever an empty vessel in the closed position under the influence of its own forces has to be kept in said closed position when receiving a charge.

Accordingly in this case there is started from the closed position in which it has to be assured only that the correct pressure prevails at the rod side of the cylinders. The only difference in comparison with the closure under high pressure is accordingly that the magnetic valve S7 is not energized so that consequently no control pressure is exerted on the non return valve G2 and said non return valves does consequently not allow any back flow which however is not required.

By means of 3 the situation has been indicated for opening i.e. opening of the vessel on its own accord under the influence of the charge and opening of the vessel by means of pumps, respectively.

In both cases the magnetic valves S6 and S8 are energized. First of all this means that the pressure of the pumps 41 is supplied to the line 51 by way of 50 and S8 and consequently to lines 48 in the piston rods at the head side of the cylinder. This pressure is also the control pressure for the non return valve 53, so that hydraulic liquid may flow from the rod side to the head side.

If the opening occurs too slowly then the pump pressure will take care of an opening of the desired velocity.

If the opening occurs too quickly the control pressure on the non return valve will drop causing the same to close. The opening movement is thereby retarded.

The scattering of the charge indicated by 2*a* in the functional diagram occurs when the hopper is partially opened. For this function only the magnetic valve S8 is energized for a short period whereby the pressure in the lines 51 and 48 and consequently also the pressure in the control pressure line of the non return valve 53 may flow away to the tank 42 by way of the line 5*o* and the pressure regulating valve 46 in opened position because the magnetic valve S6 is de-energized. In this way it is assured that non return valve 53 will close and that a black flow of pressure liquid from the rod side by way of the non return valve to the head side is interrupted. In case of a vessel which is apt to open spontantaneously such aptitude is consequently suppressed. In case of a vessel having the aptitude of self-closure a back flow of the hydraulic liquid from the head side of the cylinders by way of the line 51 is not possible because there will be no control pressure on the non return valve G2.

From the functional diagram it will be furthermore apparent that for rinsing the hopper, the same now being empty, though having to be opened partially none of the magnetic valves is energized. Accordingly in this case the same situation occurs as in scattering the charge after de-energization of the magnetic valve S8. In case of a self-opening as well as in case of a self-closing vessel the fixation of the partially opened position is maintained in the same way as utilized when scattering the charge.

FIG. 6 shows a conventional split hopper vessel 100 consisting of two halves 101 and 102 fitting together along the longitudinal central cross-sectional plane and connected to each other by means of hinges 103 having a horizontal axis. The cylinders 8, 9, interconnecting the halves to close them and to control their opening, function as described above.

I claim:

1. For use with a split hopper or similar vessel consisting of two halves fitting together along the longitudinal central cross-sectional plane and being connected to each other by means of hinges having a horizontal axis, hydraulic cylinders adapted to be positioned in the neighborhood of said hinges to couple said two halves to one another, which hydraulic cylinders are capable of at least performing the closing movement of said two halves and have been included in a hydraulic circuit in which circuit close to said cylinders flexible tubes have been provided for transferring hydraulic liquid to and from said cylinders; the improvement in which in the pressure supply line there is provided a non-return valve between each cylinder and each flexible tube, said non-return valve (10,11,53) passing liquid in the direction of closing and blocking in the reverse direction, said non-return valve furthermore being provided with a control means for opening said valve under the influence of a control pressure, between the rod side and the head side of a each cylinder there being provided a non-return valve (G1, 53) which blocks the passage from the rod side to the head side and which may be opened under the influence of a control pressure, the control pressure on the latter non-return valve (G1) being dependent on the presence of control pressure on all the first-mentioned non-return valves (10,11) provided for all cylinders between flexible tubes and cylinders, and for each one of the non-return valves (10,11) present between flexible tubes and cylinders there is provided a switch (E1,E2) capable of being activated by the control pressure, which switches when they are all in the activated position thereof complete an electric circuit through an electromagnetic valve (S1) in the control pressure line to the non-return valve (G1) between the rod side and the head side of each cylinder, to move said valve (S1) into a position in which said valve (S1) passes the control pressure to said latter non-return valve (G1).

2. The ship according to claim 1 in which in the hydraulic circuit between the head side of the cylinders and the tank there is provided a controllable non return valve (G2) preventing the back flow to said tank.

3. The ship according to claim 2 in which the control pressure of the non return valve (G2) is derived from the pressure in the line between the head side of the cylinders and a throttling site present upstream of the non return valve while in the control pressure line there is provided an electromagnetic valve (S2).

4. The ship according to claim 2 in which the control pressure of the controllable non return valve (G2) is derived directly from the pressurized portion of the hydraulic circuit by means of an electromagnetic valve (S7).

5. The ship according to claim 1 in which the hydraulic circuit consists of a high pressure section and a low pressure section, which high pressure section by means of an electromagnetic valve (S4) may supply hydraulic liquid to the cylinders by way of the non return valves (10,11) and by means of another electromagnetic valve (S3) may supply hydraulic liquid to the control line of the non-return valves (10,11) as well as by means of an electromagnetic valve (S1) to the control line of the non return valve (G1) between rod side and head side of the cylinder, the last said valve (G1) being present close to that cylinder which is most remote from the pressure source in the tank while the low pressure section connects the head size of the cylinders to the tank by way of conduits provided with non return valves admitting a flow from said tank to the head side, of which non return valves at least one (G2) is controlled and the control line of which may be connected to the low pressure section by means of an electromagnetic valve (S2).

6. The ship according to claim 1 in which the hydraulic circuit consists of a high pressure section including high pressure pumps of low capacity and a medium pressure section including medium pressure pumps of high capacity as well as a low pressure section, an electromagnetic valve (S9) for connecting the rod side at wish to the high pressure section or the medium pressure section, respectively, electromagnetic valves (S5 and S6) for by-passing the high pressure pumps or medium pressure pumps, respectively, while all controllable non return valves are present in the medium pressure section of the circuit, said non return valves receiving the control pressure from the medium pressure section of the circuit, and the high pressure section is connected to the rod side of the cylinders by way of a non-controllable non retrurn valve, said valve being present between each flexible tube and the cylinder, an electromagnetic valve (S7) in the control pressure line to the non return valve (G2) in the return line from the head side of the cylinders to the tank, said control pressure line being connected to both the high pressure and the medium pressure by way of non return valves and an electromagnetic valve (S8) in the connection between medium pressure to the head side of the cylinders.

7. The ship according to claim 6, in which a manually operable connection is provided between the high pressure section connected to the rod side of a cylinder and the medium pressure section connected to the head side thereof.

* * * * *